US007201654B1

(12) United States Patent
Jarvis et al.

(10) Patent No.: US 7,201,654 B1
(45) Date of Patent: Apr. 10, 2007

(54) POKER GAME WITH SECONDARY BET OPPORTUNITY

(75) Inventors: Eugene Jarvis, Park Ridge, IL (US); Andrew Eloff, Evanston, IL (US)

(73) Assignee: Raw Thrills, Inc., Niles, IL (US)

( * ) Notice: Subject to any disclaimer, the term of this patent is extended or adjusted under 35 U.S.C. 154(b) by 131 days.

(21) Appl. No.: 10/077,740

(22) Filed: Feb. 14, 2002

(51) Int. Cl.
*A63F 9/24* (2006.01)

(52) U.S. Cl. ..... 463/13

(58) Field of Classification Search ..... 463/11, 463/12, 13; 273/292, 293, 303
See application file for complete search history.

(56) References Cited

U.S. PATENT DOCUMENTS

| | | | | |
|---|---|---|---|---|
| 4,651,997 | A | 3/1987 | Wood | |
| 5,098,107 | A | 3/1992 | Boylan et al. | |
| 5,280,915 | A | 1/1994 | Groussman | |
| 5,288,082 | A | 2/1994 | Marquez | |
| 5,366,228 | A | 11/1994 | Kangsanaraks | |
| 5,415,414 | A | 5/1995 | Savage | |
| 5,636,843 | A * | 6/1997 | Roberts | 273/292 |
| 5,685,774 | A | 11/1997 | Webb | |
| 5,732,950 | A | 3/1998 | Moody | |
| 5,755,621 | A | 5/1998 | Marks et al. | |
| 5,810,354 | A | 9/1998 | Banyai | |
| 5,823,873 | A | 10/1998 | Moody | |
| 5,954,335 | A | 9/1999 | Moody | |
| 6,007,066 | A | 12/1999 | Moody | |
| 6,227,969 | B1 * | 5/2001 | Yoseloff | 463/13 |
| 6,248,016 | B1 | 6/2001 | Walker et al. | |
| 6,332,839 | B2 | 12/2001 | Walker et al. | |
| 6,416,407 | B1 * | 7/2002 | Carrico et al. | 463/13 |
| 2001/0003709 | A1 | 6/2001 | Adams | |
| 2001/0054797 | A1 * | 12/2001 | Lo | 273/292 |
| 2002/0074724 | A1 * | 6/2002 | Webb | 273/274 |

FOREIGN PATENT DOCUMENTS

EP 0981118 A2 * 2/2000

* cited by examiner

*Primary Examiner*—Corbett B. Coburn
(74) *Attorney, Agent, or Firm*—Patzik, Frank & Samotny, Ltd.

(57) ABSTRACT

This invention relates to a poker game implemented on a video gaming machine wherein the player is provided with an opportunity to place two wagers, a first wager wherein the player bets that each final hand will contain any one of a plurality of preselected card combinations, and a second wager wherein the player bets that one or more of the final hands will contain a specific card combination. During a "round of play," the player is initially dealt a hand of cards after making the first wager. After reviewing the hand, the player chooses which cards, if any, he or she wishes to "hold" and whether to draw additional cards in an attempt to improve the value of his or her hand. Thereafter, the player may place a second wager that the final hand will contain a particular combination of cards that improves the ranking of his initial hand. If the final hand contains the combination that the player wagered upon, the player is provided with a predetermined payout, in addition to the payout, if any, based on the original wager.

11 Claims, 14 Drawing Sheets

POKER GAME WITH SECONDARY BET OPPORTUNITY

FIELD OF THE INVENTION

This invention relates generally to a playing card-based game, and more particularly to a poker game preferably implemented on a video gaming machine wherein the player is provided with an opportunity to place two wagers, a first wager wherein the player bets that one or more final hand will contain any one of a plurality of preselected card combinations, and a second wager wherein the player bets that one or more of the final hands will contain a specific card combination.

BACKGROUND OF THE INVENTION

Many single and multiplayer playing card-based games or "card games" games have been devised that require the use of a deck of fifty-two playing cards. The deck consists of cards of four suits, namely spades, hearts, diamonds and clubs. Each suit contains thirteen cards which, when ranked in decreasing order, consist of an Ace, King, Queen, Jack, 10, 9, 8, 7, 6, 5, 4, 3 and a 2.

During a "round of play" for many conventional card games, a dealer deals each player an initial "hand" or set of cards. The player then reviews his or her hand (without revealing all or a portion of their hand to the other players), discards some or all of his or her cards, and the dealer then gives the player an equal number of cards to replace the cards discarded. This procedure of discarding and replacing cards may occur one or more times, until finally the round of play terminates and all of the players reveal their hands to the other participating players, at which time the winning hand is determined.

One particular card game is poker. The game of poker is conventionally played by a plurality of players who are dealt cards from a deck of fifty-two playing cards. A poker hand typically consists of five or more cards, and has a winning high value or poker rank that is determined by the combinations set forth below, which are ranked in decreasing order based upon the mathematical probability of their occurrence:

A. Royal Flush—Ace, King, Queen, Jack and 10, all of the same suit;

B. Straight Flush—five cards in ranking sequence, all of the same suit;

C. Four-of-a-kind—four cards of the same rank;

D. Full House—three cards of one rank and two cards of another rank;

E. Flush—five cards of the same suit, not in ranking sequence;

F. Straight—five cards in ranking sequence, not all of the same suit;

G. Three-of-a-Kind—three cards of the same rank;

H. Two Pairs—two cards of one rank and two cards of another rank;

I. One Pair—two cards of the same rank.

A hand that does not have any of the above combinations is ranked by the highest-ranking card it contains, as well as the next highest cards in decreasing order of their rank.

Poker is often played with a deck containing one or two Jokers as a fifty-third and/or fifty-fourth card, designated as wild (i.e. to represent any card its holder does not have, or to represent an Ace or any card needed to complete a Straight or a Flush). There are also numerous variations of poker with different wild cards and varied payouts and bonuses for different types of hands.

The two basic forms of poker are draw poker and stud poker. With each form, each player normally places a bet of a predetermined amount (generally referred to as an "ante") before any cards are dealt. The ante is a sort of entrance fee for each player, and gives the player the right to receive an initial hand of cards. In the game of draw poker, each player is dealt five cards face down. Each player reviews his or her hand to determine whether to withdraw from the game (generally referred to as "folding"), or to continue participating in the round. Each active or remaining player may then, at his or her option, discard any of his or her cards, and the dealer then gives the player an equal number of cards to replace the cards discarded. This replacement of discarded cards is called the "draw", and the right of each player to discard cards from his or her closed five-card hand as initially dealt and to draw the same number of cards as replacements for the discarded cards, is one of the characteristics distinguishing draw poker from stud poker. In stud poker, cards are not normally discarded.

A second betting round among the remaining players follows, after which there is a "showdown" in which the players' hands are compared with one another to determine which player wins. Conventionally, in both draw poker and stud poker, the player holding the highest-ranking poker hand of all players at the showdown wins.

Poker, as well as many other forms of playing card games such as blackjack and the like, has been adapted in various forms to casino play. In one type of casino poker, each player plays against each of the other players seated about a table with all bets being contributed to a pot, which is the conventional manner by which the game is played. In another type of casino poker, each of the players plays against the dealer, wherein whether the player wins depends on whether the player's hand is superior to the dealer's hand, and wherein the payout is determined by a predetermined formula (i.e. the player is given 1000 to 1 odds that he or she will beat the dealer by way of a royal flush).

Generally, the casino provides the table accommodations along with, in most jurisdictions, a dealer who deals the cards, provides gaming tokens or chips to the players for placing bets, watches the pot to make sure all the players are contributing chips as they should, and compares and announces the winning hands. In return for these services, the casino charges a fee, such as a "rake" (a portion of the pot) or an hourly fee collected from each player.

The casino may also or in the alternative provide players with the opportunity to play poker using a conventional video gaming machine. These video gaming machines generally operate in the following manner. The player provides the "ante" by inserting money or tokens into the machine. The video gaming machine then randomly deals a hand of cards from a standard deck of fifty-two cards. The cards are randomly chosen by the processor and visually displayed to the player on a video display. The player then draws by selecting which cards to discard. The video gaming machine then randomly deals the replacement cards from the cards remaining in the deck, and displays the replacement cards on the video display. The payout provided by such conventional video gaming machines, if any, is generally determined by the content of the final hand. The final hand is compared against an "initial bet pay table" that determines the payout for the player. See, Table 2 for a sample pay table.

However, while such conventional video gaming machines do provide a player with the opportunity to play conventional poker, they can fail to maintain the game at a level challenging enough to keep the player interested. There is a constant need in the gaming industry for new games that keep players interested, and substantially reduce the possibility that players will cease playing and wagering or reduce the amount of play and wagering due to lack of interest or challenge. Hence, conventional video gaming machines can fail to captivate the attention of the player, and therefore fail to maximize revenue for the casino. Many video gaming machines have been previously devised to overcome this problem by adding rules or procedures to the game of poker itself.

For example, U.S. Pat. No. 5,636,843 to Roberts discloses a method for playing blackjack or poker that can be played on a conventional play table or on a video gaming machine. Where the game is played on a conventional play table, the playing table includes prop or side bet spots. During the game, a player can make a side bet on what the characteristics of the initial hand of cards (for example, during blackjack, that the first two cards drawn will be odd, will be a pair, will be of a particular suit, etc.). The side bet can take into account the player's cards in combination with the dealer's cards. Before an initial hand of cards is dealt, the player places a bet on the overall outcome, and places another bet on what the characteristics of the first two or three cards dealt will be.

U.S. Pat. No. 5,366,228 to Kangsanaraks discloses a method for playing a card game, wherein the goal of the game is to acquire a hand having a total of 9 points. The Ace through 9 of each suite are counted at face value, and the ten, Jack, Queen and King are counted as zero. The player can automatically win additional money if the player has a two or a three-card flush. Two cards are initially dealt in the game, and the player can optionally draw a third card.

U.S. Pat. No. 4,651,997 to Wood discloses an "in between" type card game. In this game, two cards are drawn. A wager is then made on whether the next drawn card will fall within the range defined by the first two drawn cards. For example, if a 2 and 5 card are drawn first, then player can then wager an amount that the next drawn card will be either a 3 or a 4 card.

Unfortunately, these games can complicate play with sophisticated concepts and rules, which are geared more towards players with extensive playing. Furthermore, these previously devised games require a great deal of time to complete a single round of play, which is not conducive to a casino environment.

U.S. Pat. No. 5,823,873 discloses a multi-hand poker game, wherein the player makes an initial pay table bet and plays a number of poker games simultaneously. As typical of current video poker games the player makes only an initial wager before the game starts, and before he sees the cards in the initial deal. In contrast to these traditional games, the present invention allows the player to make a wager on the composition of the final hand after the initial deal. This is more exciting since the player can wager on a specific card combination in the final hand that is quite likely, as opposed to the initial wager that is made before it is known how the hand will develop.

Therefore, it is a first object of the present invention to provide an electronic game that adds to the excitement of poker card games.

It is a second object of the present invention to provide an electronic game that is easy to play, and requires a minimal knowledge of the workings of any particular playing card game.

It is a third object of the present invention to provide a playing card game that can be implemented on a video gaming machine in a casino for gambling purposes.

Yet another object of the present invention is to provide a playing card-related electronic game that provides a player with the opportunity to place two wagers, a first wager wherein the player bets that the final hand will contain any one of a plurality of preselected card combinations (initial paytable bet), and a second wager wherein the player bets that the final hand will contain a specific card combination. By giving the player the opportunity to make this additional wager more money is bet on a poker game in almost the same amount of gambling time. This increases the casino income per hour of gambling.

SUMMARY OF THE INVENTION

This invention relates generally to a poker game implemented on a video gaming machine wherein the player is provided with an opportunity to place two wagers, a first wager wherein the player bets that the final hand will contain any one of a plurality of preselected card combinations (initial pay table bet), and a second wager wherein the player bets that the final hand will contain a specific card combination. Preferably, the game is implemented in conjunction with a conventional playing card-based poker game. In the most preferred embodiment, the game is implemented in conjunction with five-card draw poker.

During a "round of play" of the game of the present invention, the player first places an initial wager (initial pay table bet) betting that the final hand will contain any one of a plurality of preselected card combinations (i.e. royal flush, full house and the like). After the initial cards are dealt, but before the draw, the player has the opportunity to place a second wager that the final hand will contain a particular combination of cards. For example, if the player is initially dealt a hand containing a pair, the player could elect to hold the pair and wager that when the discarded cards are replaced, the final hand will contain a three-of-a-kind. If the final hand contains the combination that the player wagered upon, the player is provided with a payout based upon the odds offered on the second wager. At the conclusion of the hand the first pay table wager is also settled. The invention may be used where the player plays a single hand of poker at a time, or when multiple hands are played simultaneously.

The invention provides a method for playing a draw poker game including initially dealt cards, an opportunity for the player to hold at least one of said initially dealt cards and a final hand composition of cards also referred to as the final hand. The method comprises: placing a first wager that a final hand composition will match one of a plurality of preselected combinations of cards; dealing a hand of initially dealt cards; selecting none, one, or more held cards from said hand of dealt cards; offering at least one proposition bet based on a possible final hand composition, unless all initially dealt cards are held; accepting the at least one proposition bet as a second wager if the proposition bet is offered; dealing one additional card to replace each card not held to provide a final hand composition; determining if the final hand composition matches the at least one proposition bet, if the at least one proposition bet is offered and accepted; and determining if the final hand matches one of the plurality of preselected combination of cards as to the first wager.

The possible final hand composition of the proposition bet is an improved poker hand as compared to the hand of initially dealt cards. The poker game is 5-card draw poker. In addition, the held cards are automatically held upon acceptance of the second wager.

In the alternative, the method for playing a draw poker game includes initially dealt cards, an opportunity for the player to hold at least one of said initially dealt cards and a final hand composition, comprises: placing a first wager that a final hand composition will match one of a plurality of preselected combinations of cards; dealing a hand of initially dealt cards; offering at least one proposition bet based on a possible final hand composition, unless it is not possible to improve the poker hand ranking of the initially dealt cards; selecting none, one, or more held cards from the hand of dealt cards; accepting the at least one proposition bet as a second wager, if the proposition bet is offered; dealing one additional card to replace each card not held, to provide a final hand composition; determining if the final hand composition matches the at least one proposition bet, if at least one proposition bet is offered and accepted; and determining if the final hand composition matches one of the plurality of preselected combination of cards as to the first wager. The poker hand ranking of the possible final hand composition relating to the proposition bet, is an improved poker hand ranking as compared to the poker hand ranking of the initially dealt cards.

In another version, the method for playing a poker game includes an initially dealt hand of cards, a final hand composition and rankings of the poker hands, the method comprising: placing a first wager that a final hand composition will match one of a plurality of preselected combinations of cards; dealing one or more dealt cards; analyzing the dealt cards and undealt cards to determine possible final hand compositions; providing at least one proposition bet for at least one possible final hand composition; accepting the at least one proposition bet so as to make a second wager; dealing the necessary cards to complete the hand providing the final hand composition; determining if the final hand composition matches the at least one proposition bet; and determining if the final hand matches one of a plurality of preselected combinations of cards with respect to the first wager.

The present invention also comprises a poker game played by a player including an initial hand of cards and a final hand of cards, including: a computing device for implementing the game, the computing device having a screen display; a microprocessor in communication with the screen display; a selection device in communication with said microprocessor for providing means by which the player interacts with the computing device; a power supply in electrical communication with the screen display, the microprocessor and the selection device for providing power thereto; a hand of cards displayed on the screen display; card determining means in communication with the computing device for randomly determining in succession the composition of the initial hand of cards and for randomly determining the composition of the final hand of cards; and card combination determining means for analyzing the hand of cards to determine possible final hands so as to provide the player with at least one proposition bet to select based on the composition of the final hand.

Similarly, the present invention includes a poker game played by a player including an initial hand of cards and a final hand of cards, the game comprising: a computing device for implementing the game, the computing device having a screen display; a microprocessor in communication with the screen display; a selection device in communication with the microprocessor for providing means by which the player interacts with the computing device; a power supply in electrical communication with said screen display, the microprocessor and the selection device for providing power thereto; a hand of cards displayed on the screen display; card determining means in communication with the computing device for randomly determining in succession the composition of said initial hand of cards and for randomly determining the composition of the final hand of cards; and card combination determining means for analyzing the hand of cards to determine possible final hands to provide the player with a plurality of proposition bets to choose from, and, the card determining means determining the composition of the final hand of cards and dealing the cards needed to complete the hand, so as to provide a payout to the player based on the composition of the final hand of cards.

In addition, the invention includes a method for playing poker on a video draw poker gaming machine including an initial deal of cards and an opportunity to hold certain of the initially dealt cards and draw additional cards so as to result in a final composition of the player's hand, the method comprising: making a wager on the final composition of the player's hand after the initial deal, but before the draw. The wager is that one or more of the final hands will contain a specific card combination. The specific card combination is one or more of the following: Royal Flush, Straight Flush, Straight, Flush, Full House, Three of a Kind, Two Pair and One Pair. The machine automatically determines the player cards to hold when the player places the wager.

BRIEF DESCRIPTION OF THE DRAWINGS

Other objects and advantages of the invention will become apparent upon reading the following detailed description and upon reference to the drawings in which.

WRITTEN DESCRIPTION OF THE INVENTION

Figure 1:
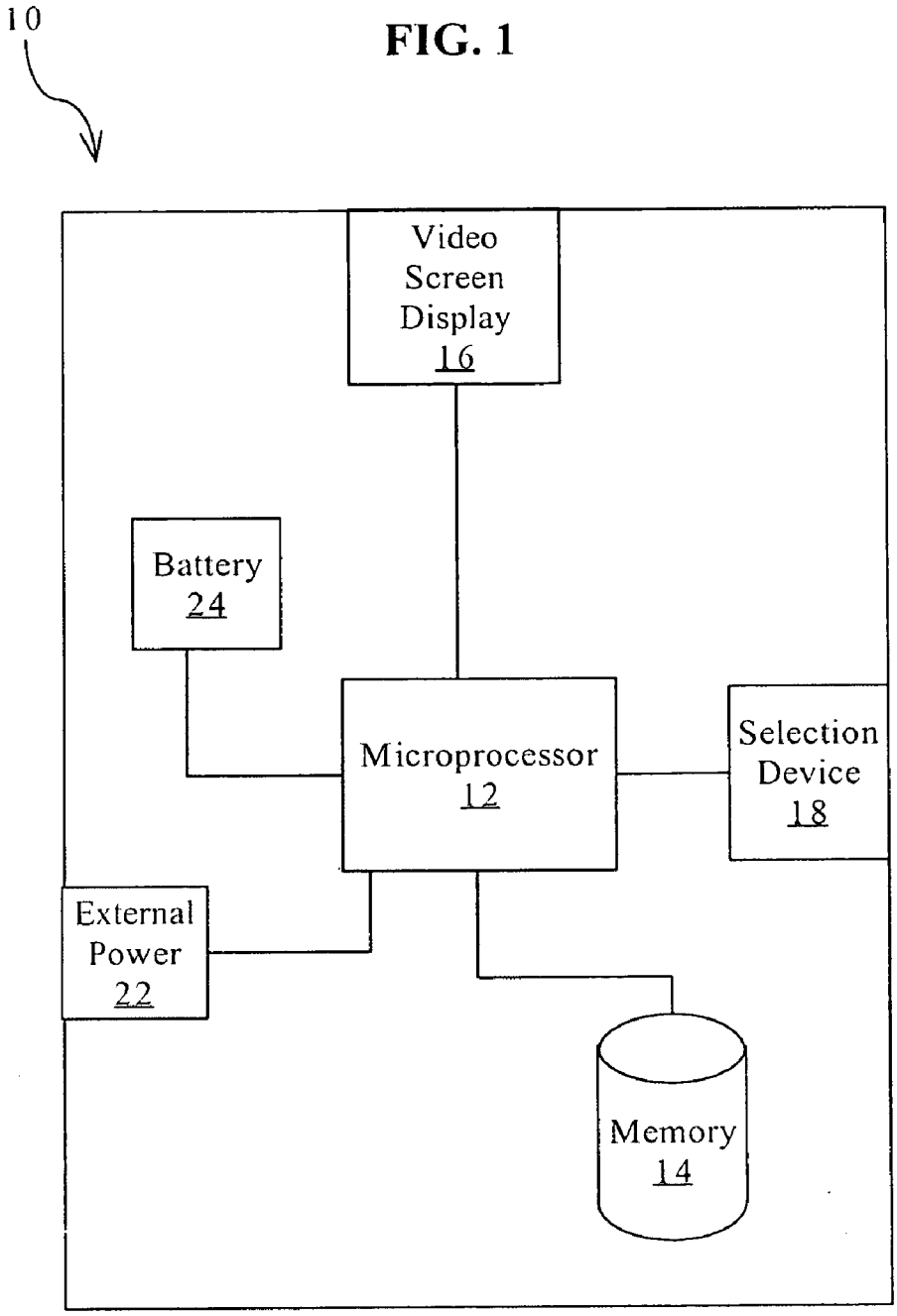
FIG. 1 is a schematic diagram of a computing device.

While this invention is susceptible of embodiment in many different forms, there is shown in the drawings and will herein be described in detail, one or more specific embodiments, with the understanding that the present disclosure is to be considered merely an exemplification of the principles of the invention and is not intended to limit the invention only to the embodiments described and illustrated.

The game of the present invention can be played on a conventional playing card table or on any electronic computing device. The game is most preferably played in a casino as a video gaming machine for gambling purposes. Alternatively, it can be played on a computing device (i.e. a desktop computer or PC, a laptop or other portable computer, a cellular telephone, a personal digital assistant or PDA, or other such computing devices) as an on-line gaming game over the Internet as part of a Wide Area Network ("WAN"), as part of a Local Area Network ("LAN"), a wireless LAN ("WLAN") and/or on a stand-alone computing device.

FIG. 1 is a schematic diagram of a computing device 10 with which the present game is implemented. The computing device 10 includes a microprocessor 12 for executing one or more programs stored in the device's memory 14, a video screen display 16, a selection device 18 for providing a means by which the player interacts with the computing device 10, and an external power supply 22 and/or a battery 24 in electrical communication with each of the above-noted components for providing electrical power thereto. The memory 14, video screen display 16, and selection device 18 are each in communication with the microprocessor 12.

The selection device 18 may be a keypad, a peripheral device such as an external keyboard or mouse, and/or a plurality of function specific buttons. In the preferred embodiment, the video display screen 16 is a touch screen that serves as both the selection device 18 and the video screen display 16 wherein player selections are processed through tactile input. In this embodiment, the selection device 18 takes the form of "interactive" buttons that appear on the video screen display 16. When the player touches the video screen display 16 at the location where the "interactive" button is displayed, this has the same affect as if the player were pushing a conventional electro-mechanical keypad button.

As will be further discussed below, during a "round of play" of the game of the present invention, the player is initially dealt a hand of cards. After reviewing the hand, the player chooses which cards, if any, he or she wishes to "hold," and the remaining (non-held) cards, if any, are discarded. Thereafter, the player has the option of placing a wager that the final hand will contain a particular combination of cards. For example, if the player is initially dealt a hand containing a pair, the player could elect to hold the pair and wager that when the discarded cards are replaced, the final hand will contain a three-of-a-kind. If the final hand contains the combination that the player wagered upon, as will be fully discussed below, the player is provided with a predetermined payout.

In the case of the invention being used in a stud poker game, after a certain number of cards are revealed to the player, but before all the cards to the hand have been revealed, the player has an opportunity to make another wager, in addition to any other wagers already placed, that the player's final hand will contain a particular combination of cards.

The game of the present invention can be played as a stand-alone game, or can be played as a "side-bet" game in conjunction with a conventional poker game. In a stand-alone game, the player's sole wager would be that the player's final hand contains a particular combination of cards. In the "side bet" game embodiment, the player is provided with the opportunity to place two wagers, and therefore the player is provided the opportunity to win two payouts. Conversely, the establishment is provided with the opportunity to win two wagers. First, the player places an initial wager, often known as a pay table bet or wager, betting that the final hand will contain any one of a plurality of preselected card combinations (i.e. royal flush, full house and the like). The player then has the opportunity to place a second wager after the cards are dealt, but before the draw, betting that the final hand will contain a particular card combination. This wager is referred to below as the "GO4IT" wager. In addition, the player can play one hand at a time, or optionally can play multiple hands simultaneously.

In the preferred embodiment, the game of the present invention is implemented in conjunction with five-card, single-draw poker wherein the player, at his or her option, can play multiple hands simultaneously.

Figure 2:
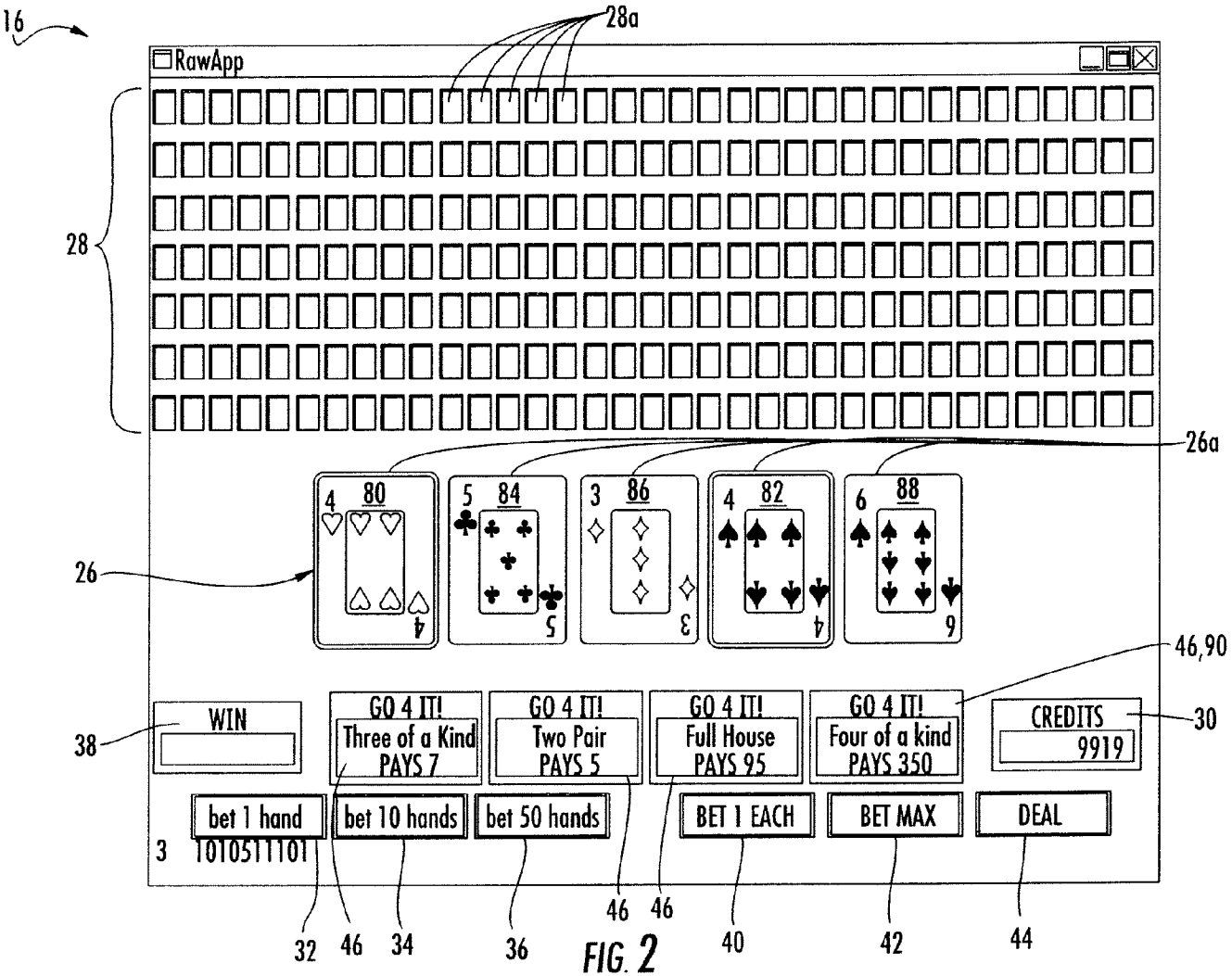
FIG. 2 is an illustration of a screen display of a first example of a round of play after an initial hand of interactive cards has been dealt.

FIG. 2 is an illustration of a screen display 16 of an initial round of play of the game of the preferred embodiment, as implemented on a computing device 10 having a touch screen video screen display 16. In this embodiment, the screen display 16 includes a row of interactive face-up cards generally designated as reference number 26. The face-up cards 26 are divided into four categories, and which category a card 26 falls into varies depending on the stage in the round of play. Specifically, the interactive cards which are initially dealt at the start of the round of play ("interactive dealt cards") are designated as reference number 26*a*, the interactive cards designated by the player to be held ("interactive held cards") are designated as reference number 26*b* (see FIG. 4), the interactive cards implicitly designated by the player to be discarded ("interactive discarded cards") are designated as reference number 26*c* (see FIG. 4), and the interactive cards dealt to replace the discarded cards ("interactive drawn cards") are designated as reference number 26*d* (see FIG. 5).

In the most preferred embodiment, where the player plays multiple hands, the player only chooses which cards to hold 26*b* with respect to one hand, namely the hand of interactive cards 26. The held cards 26*b* are then applied against all of the hands played, thereby providing multiple identical "pre-draw" hands. In this embodiment, the hands played in addition to the hand of interactive cards 26 are shown as rows of static face-down cards generally designated as reference number 28. These cards 28 are designated as "static" because there is no interaction between the player and these cards 28. In the most preferred embodiment, the screen display 16 includes forty-nine hands of face-down cards 28, thereby providing the player with the opportunity to wager against a total of fifty hands.

The static cards 28 are divided into three categories, and which category a static card 28 falls into varies depending on the stage in the round of play. Specifically, the static cards which are face-down during the round of play ("static dealt cards") are designated as reference number 28*a* (see FIG. 2), the static face-up cards corresponding to the interactive held cards 26*b* designated by the player to be held ("static held cards") are designated as reference number 28*b* (see FIG. 4), and the face-up static cards dealt to replace the discarded cards ("static drawn cards") are designated as reference number 28*c* (see FIG. 5).

Referring again to FIG. 2, a "CREDIT" display 30 provides the player with a visual display of the total number of credits available to bet or wager with. "BET 1 HAND", "BET 10 HANDS", and "BET 50 HANDS" interactive buttons 32, 34 and 36, respectively, permit the player to select the number of hands to play during the round of play. In the alternative, an interactive button (not shown) could be provided which permits the player to select the number of hands to play, wherein the number of hands played would be an integer between 1 and the maximum number of playable hands. A "WIN" display 38 provides the player with a visual display of the total number of credits won for a given round of play after the round of play has terminated. A "1 BET EACH" interactive button 40 permits the player to bet 1 credit for each hand played. A "MAX BET" interactive button 42 permits the player to wager the maximum allowable credits for each hand. The player uses a "DEAL" interactive button 44, to deal an initial hand of interactive dealt cards 26*a*, and to deal replacement interactive cards 26*c* after the player has selected which cards 26*b* to hold.

As will be further discussed below, the screen display 16 includes a plurality of "GO4IT" interactive buttons 46. Each "GO4IT" interactive button 46 visually displays a particular card combination (i.e. three-of-a-kind, two pair, full house, and the like) and the payout value associated with each card combination. The "GO4IT" interactive buttons 46 provide the player with a means by which to wager that a particular card combination will be present in any one or more of the final hands. "GO4IT" is the term used herein to describe the second wager that the player can place during a hand. The "GO4IT" wager is placed after the initial deal, but before the final cards are drawn to complete the hand.

Figure 3:
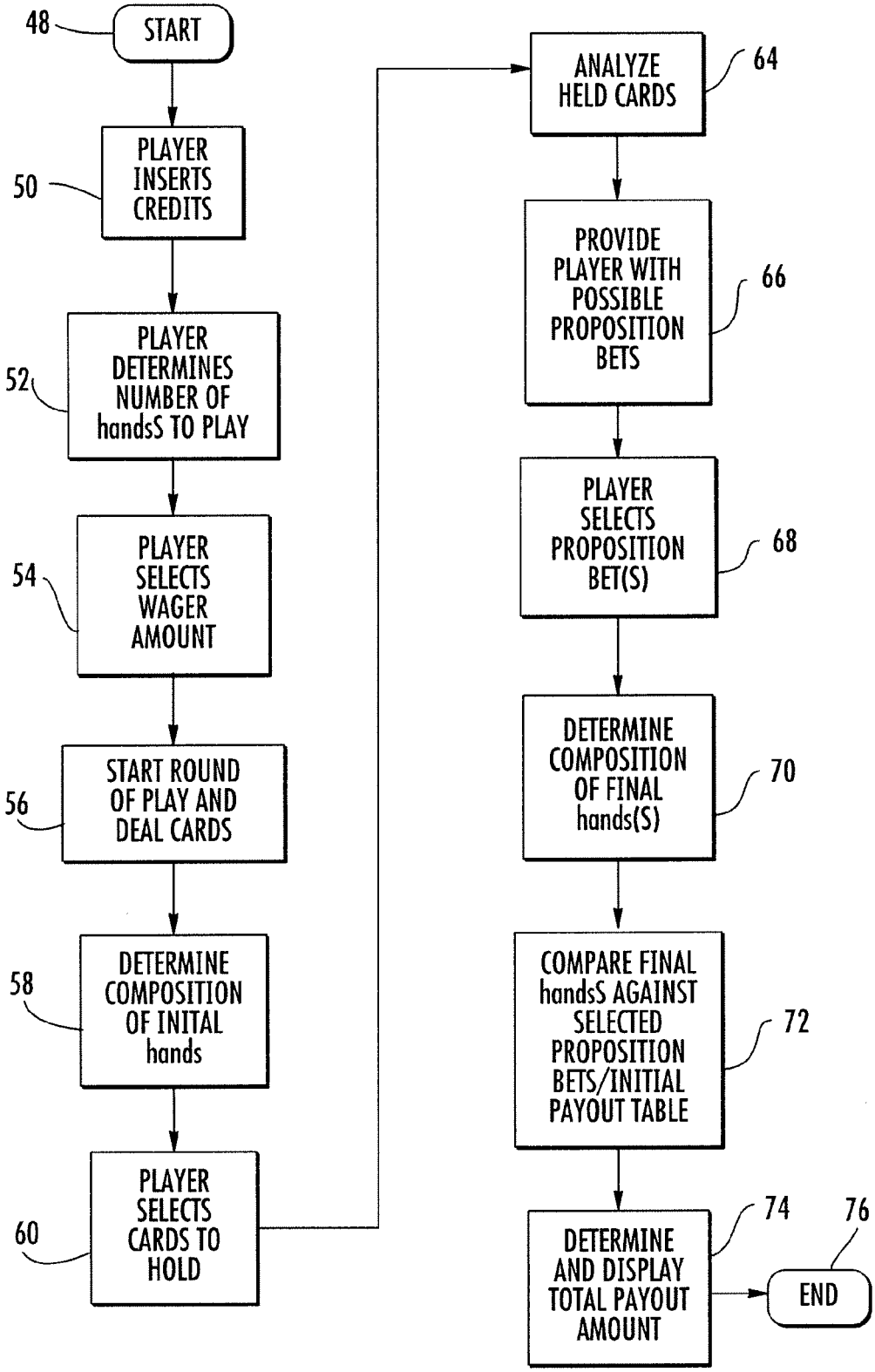
FIG. 3 is a flow diagram of a round of play.

FIG. 3 is a flow diagram that generally describes one method by which a round of play is accomplished. In this embodiment, the computing device 10 is the preferred video gaming machine. After start 48, but before the round of play begins, the player inserts "credits" 50 into the computing device 10. These credits may take the form of coins, or could be deducted from a stored value card, a ticket, a debit card, a credit card, a smart card, or the like. Thereafter, the player determines the number of hands to play 52 for the upcoming round of play using the "BET 1 HAND", "BET 10 HANDS", and "BET 50 HANDS" interactive buttons 32, 34 and 36, respectively.

Next, the player selects the amount to be wagered 54 for the first wager with respect to each hand. In other words, the player places a bet with respect to each hand that the final composition of that hand will contain one of the preselected card combinations. Placing this wager can be accomplished two ways. First, the player can touch the "MAX BET" interactive button 42, in which case the maximum allowed bet is wagered for each hand. In the alternative, the player can select that one credit be wagered against each hand played using the "1 BET EACH" interactive button 40.

Once the amount wagered is selected 54, the player touches the "DEAL" interactive button 44 to initiate the round of play 56. When the round of play is initiated 56, the composition of the initial hand of interactive dealt cards 26*a* is determined 58 by card determining means associated with the computing device 10, and the initial hand of interactive dealt cards 26*a* is displayed on the screen display 16. Preferably, the card determining means is a random number generator program suitable for use in a gaming device 10. The random number generator is executed by the microprocessor 12, and determines the composition of the initial hand of interactive cards 26*a* by randomly and successively choosing each card 26*a* from among the available cards in a fictional deck of fifty-two playing cards.

Once the initial hand of interactive cards 26*a* has been determined and displayed by the computing device 10, the player then selects which initially dealt interactive cards 26*a* to hold 60. The player does this by touching or otherwise designating the particular interactive cards 26*a* the player wishes to hold. A "HOLD" indication display 62 (see FIG. 4) is displayed proximal to the interactive held card 26*b* alerting the player that the particular card 26 has been designated as a held card 26*b*. The remaining cards 26*a* in the hand are, therefore, implicitly designated as interactive discarded cards 26*c*. The player has the option of holding none of the cards, all of the cards, or a portion of the cards.

If the player plays multiple hands, after the player has chosen the interactive held cards 26*b*, those same cards 26*b* are then displayed as face-up static held cards 28*b*. In other words, if the player selects an Ace-of-spades as an interactive held card 26*b*, then an Ace-of-spades will be displayed as a static held card 28*b* on each additional hand played.

In one embodiment, "GO4IT" proposition bets are bets that the initial dealt hand can be improved to be the particular type of hand of the proposition bet, by discarding one or more cards of the initial hand and drawing that number of additional or replacement cards.

Alternatively, the GO4IT bet may be offered to a player either before or after he or she decides which cards from the initial hand to hold in an attempt to improve his or her hand. The GO4IT proposition bet may be provided to the player, for instance, only if the player discards at least one of the cards initially dealt to the player thereby electing to take at least one additional card in an attempt to improve his or her hand.

A "GO4IT" proposition bet therefore provides the player with the opportunity to wager that one or more of the final hands will contain a specific card combination matching the type of hand of the proposition bet. Whether "GO4IT" proposition bets are provided and which particular "GO4IT" proposition bets are provided could be randomly determined, could be determined according to comparison to preselected rules, could be dependent on one or more of the cards in the initial hand, could be dependent on the composition of the initial hand of cards drawn, and/or could be dependent on one or more of the cards held by the player, if any, or a combination of the above. More particularly, in one embodiment, whether or not a "GO4IT" proposition bet is provided at all, and/or the type of "GO4IT" proposition bet provided (i.e. the corresponding final hand combination needed to win the "GO4IT" proposition bet), is randomly determined in one or both instances. In other words, whether a "GO4IT" proposition bet is provided at all could be randomly determined, and the particular types of "GO4IT" proposition bets provided could be dependent on the composition of the cards in the hand initially dealt, or could be dependent on which cards the player holds. In the alternative, a "GO4IT" proposition bet could be provided each time an initial hand of cards is dealt (before any cards are selected and/or discarded), and the type of "GO4IT" proposition bet provided would depend on one or more of the cards comprising the initial hand.

In one embodiment, if the GO4IT proposition bet opportunity is provided only after the cards to be held are designated, and if all the initial cards are held (or no additional cards are selected), then no GO4IT proposition bet would be offered because no attempt is being made by the player to improve his or her hand.

In another embodiment, a first set of possible dealt hands is provided and a proposition bet opportunity is offered before the selection is made as to which cards to hold. When it is possible for the player to improve the ranking of his hand, a possible "GO4IT" proposition bet is provided to the player. Which "GO4IT" proposition bet is provided (i.e. the corresponding final hand combination matching and thereby winning the "GO4IT" proposition bet) could be randomly determined or could depend on the composition of the initial hand of dealt cards, or a combination of the above.

Alternatively, in any of the embodiments, the composition of the GO4IT proposition bets could be chosen randomly or otherwise by the card determining means from the combination of possible final hands that are rated better than the initially dealt hand contained in a database stored in memory. For example, the composition of the GO4IT proposition bets that are chosen to be offered to the player by the card determining means could be selected from a group comprising a particular number of the possible higher ranked final hands. Accordingly, this selection process would then pick from one or more yet less than all possible better hands, while still being at least somewhat random. For example, the composition of the GO4IT bets to be offered could be randomly selected from a group of three higher ranked possible final hands.

In another embodiment, if the player has chosen at least one card to hold, the computing device 10 then analyzes the held cards 26*b* using card combination determining means to determine which "GO4IT" proposition bets to provide. The card combination determining means determines all possible final hand compositions that could result after the draw 64, namely, the possible hold card 26*b*/drawn card 26*d* combinations that could be found in the final hand or hands. If no cards are selected by the player to be held, then it is contemplated that if such a bet is offered, the composition of the "GO4IT" proposition bets could be determined based on one of the methods noted above.

In one alternate embodiment, the card combination determining means includes an "auto GO4IT" feature which analyzes the initially dealt hand and determines the best ranking incomplete hand to hold, and the "GO4IT" proposition bets to be offered, and automatically decides for the player which cards should be held. To accomplish this analysis, the card combination determining means first determines all the possible combinations of hold cards 26*b*, and compares these combinations against a stored database to determine what the likely highest-ranking possible final card combinations would be. From that set of highest ranking possible final card combinations the card determining means determines randomly or otherwise which possible GO4IT proposition bets to offer. Final hands that are not possible would not be offered as GO4IT proposition bets in any embodiment.

Based on the above noted analysis 64, the computing device 10 then provides the player with proposition bets 66. In particular, for each possible final hand composition, the computing device 10 displays a "GO4IT" interactive button 46, the particular card combination (i.e. three-of-a-kind, two pair, full house and the like) associated with that button 46, and the payout value associated with that card combination. The payout value is based on the odds that the player will actually achieve the particular card combination after the draw, minus a "house edge". In other words, if the player has a 1 in 7 chance of achieving a particular card combination after the draw, a payout value may be provided which provides a payout of 5 times the wagered amount, thus providing the house with an edge.

Table 1 below provides examples of possible "GO4IT" proposition bets that could be provided based on the cards 26*b* held by the player for a given hand.

TABLE 1

| CARDS HELD BY PLAYER | "GO4IT" PROPOSITION BETS POSSIBLE |
|---|---|
| Face card | Pair, Three-of-a-kind, Full House, Four-of-a-kind, Two Pair |
| Low pair | Three-of-a-kind, Full House, Four-of-a-kind, Two Pair |
| Face pair | Three-of-a-kind, Full House, Four-of-a-kind. Two Pair |
| Two pair | Full House |
| Three-of-a-kind | Full House, Four-of-a-Kind |
| 4 card Straight | Straight |
| 3 card Straight | Straight |
| 4 card Inside Straight | Straight |
| 4 card Flush | Flush |
| 3 card Flush | Flush |
| 4 card Straight Flush | Straight Flush, Flush, Straight |
| 4 card Inside Straight Flush | Straight Flush, Flush, Straight |
| 3 card Straight Flush | Straight Flush, Flush, Straight |
| 4 card Royal | Royal, Straight, Flush |
| 3 card Royal | Royal, Straight, Flush |
| 2 card Royal | Royal, Straight, Flush |

After the computing device 10 has provided the player with the proposition bets 66, the player then selects which "GO4IT" proposition bets to accept 68. The player does this by touching the particular "GO4IT" interactive button 46 associated with the particular final hand card combination (i.e. three-of-a-kind, two pair, full house and the like) the player wishes to wager will occur as a result of the draw. The player can accept one "GO4IT" proposition bet, or in alternate embodiments multiple "GO4IT" wagers could be accepted and thereby placed. Preferably, the wager amount for each "GO4IT" proposition bet is the same amount as the first wager amount (i.e. the number of credits required to accept any "GO4IT" proposition bet is 50 credits if the first wager amount is 50 credits), though not necessarily.

After the player has selected all of the "GO4IT" proposition bets he or she wishes to accept 68 (assuming any "GO4IT" proposition bets were provided), then the player selects or touches the "DEAL" interactive button 44 and the computing device 10 deals the final hand or hands by determining the final compositions of all of the hands 70. In particular, the static drawn cards 28*c* and the interactive drawn cards 26*d* are determined by way of the card determining means, which randomly determines the composition of the static drawn cards 28*c* and the interactive drawn cards 26*d* by randomly choosing in succession each drawn card 26*d*, 28*c* from among the available cards in the fictional deck of fifty-two playing cards for each hand.

In the case of the invention being used in a stud poker game, after a certain number of cards are revealed to the player, but before all the cards to the hand have been revealed, the player has an opportunity to make another wager, in addition to any other wagers already placed, that the player's final hand will contain a particular combination of cards.

After the drawn cards 26*d*, 28*c* have been determined 70, the computing device 10 then compares the final hands against the "GO4IT" proposition bets selected by the user to determine which final hands are winning hands 72. Where a hand includes one of the winning compositions, the corresponding payout for the round of play is determined. In the embodiment where the present invention is played as a "side-bet" game in conjunction with a conventional poker game, the computing device 10 also analyzes each hand in this step 72 to determine if any of the hands include one of the preselected card combinations, which are stored in the computing device memory 14 as an "initial payout table." Examples of preselected card combinations are noted below in Table 2 for a Jacks or better pay table poker game (there are of course a large variety of pay tables for different poker games, and this pay table is just one of many possible games). Where a hand includes one of these winning compositions, the corresponding payout for the round of play is determined. The payout for these combinations are in addition to any payout received for a winning "GO4IT" proposition bet. Thereafter, the total payout for the round of play is determined and displayed 74 in the "WIN" display 38, thus ending the round of play 76.

TABLE 2

| WINNING COMBINATION | PAYOUT VALUE (credits paid out per credit wagered) |
|---|---|
| Royal Flush | 400 for 1 |
| Straight Flush | 50 for 1 |
| 4 of a Kind | 25 for 1 |
| Full House | 9 for 1 |
| Flush | 6 for 1 |
| Straight | 4 for 1 |
| 3 of a Kind | 3 for 1 |
| Pair | 2 for 1 |
| Jacks or Better | 1 for 1 |

Figure 5:
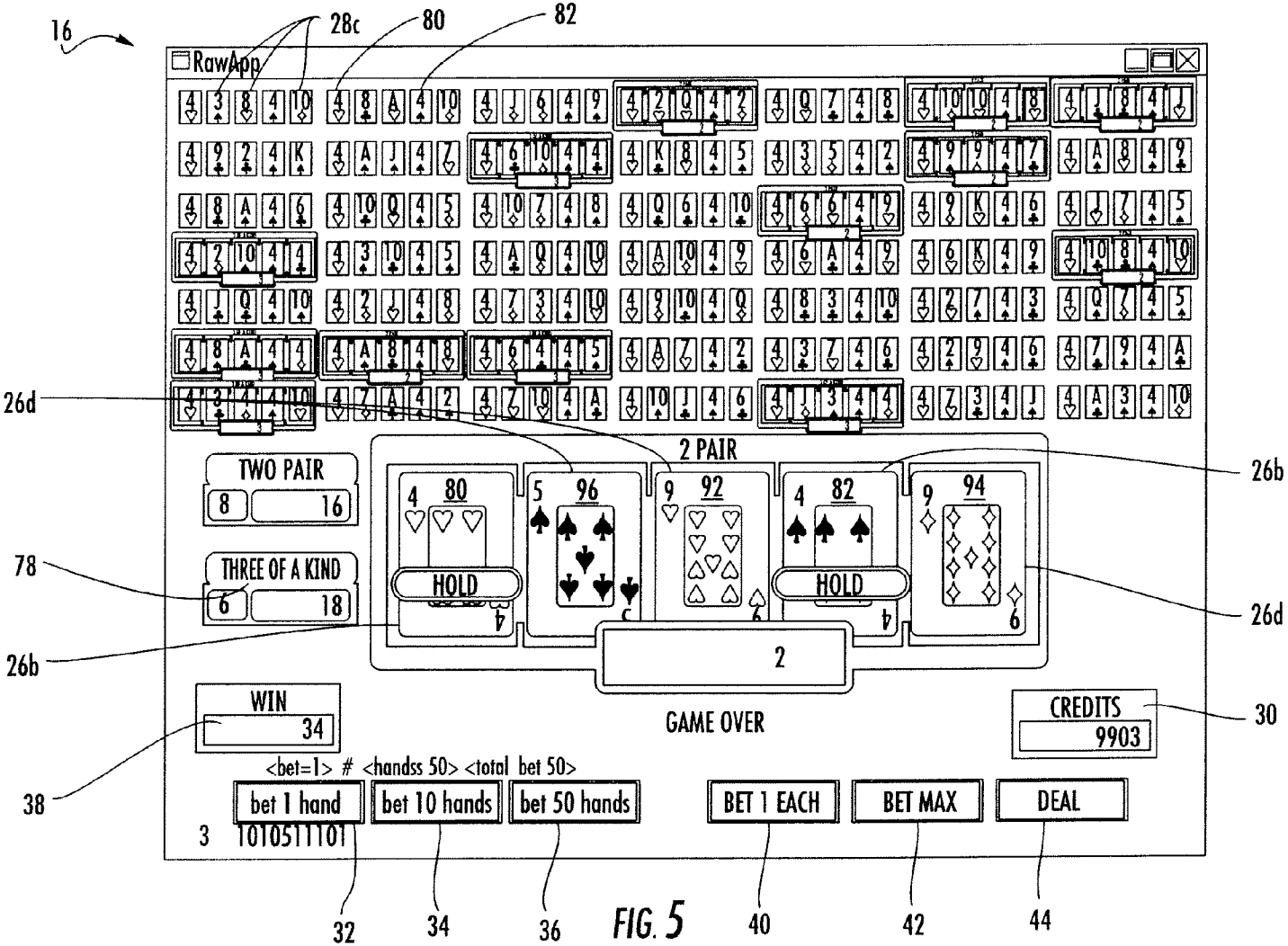
FIG. 5 is an illustration of another screen display of the first example after the draw.

As shown in FIG. 5, a card combination display 78 provides the player with a summary of the winning combinations achieved. In particular, the card combination display 78 indicates the particular winning combinations achieved, and the number of occurrences of such combinations. In addition, each winning hand is highlighted indicating to the player that the hand is a winning hand. In particular, the name of the winning combination is indicated on the winning hand, and the corresponding payout value for the winning hand is also indicated.

To provide a further understanding of the present invention, the following examples are provided with the understanding that these examples merely demonstrate the implementation of one or more embodiments of the invention. In the examples provided, the game of the present invention is implemented as a "side-bet" game in conjunction with a conventional five-card, single-draw poker game. The player is provided with an opportunity to place two wagers, a first wager wherein the player bets that each final hand will contain any one of a plurality of preselected card combinations, and a second wager wherein the player bets, after the initial deal but prior to the draw, that one or more of the final hands will contain a specific card combination.

EXAMPLE 1

FIG. 2 illustrates an example wherein the player elected to play fifty hands simultaneously, and wagered 1 credit per hand betting that each final hand will have one of a preselected card combination. Upon touching the "DEAL" interactive button 44, a hand of interactive dealt cards 26*a* was displayed. In this example, two 4's (designated as references numbers 80 and 82), a 3 (designated as reference number 84), 5 (designated as reference number 86) and 6 (designated as reference number 88) were dealt. Four "GO4IT" interactive buttons 46 were displayed indicating four possible final hand combinations in this round, and the payout value associated with each combination was also displayed.

Figure 4:
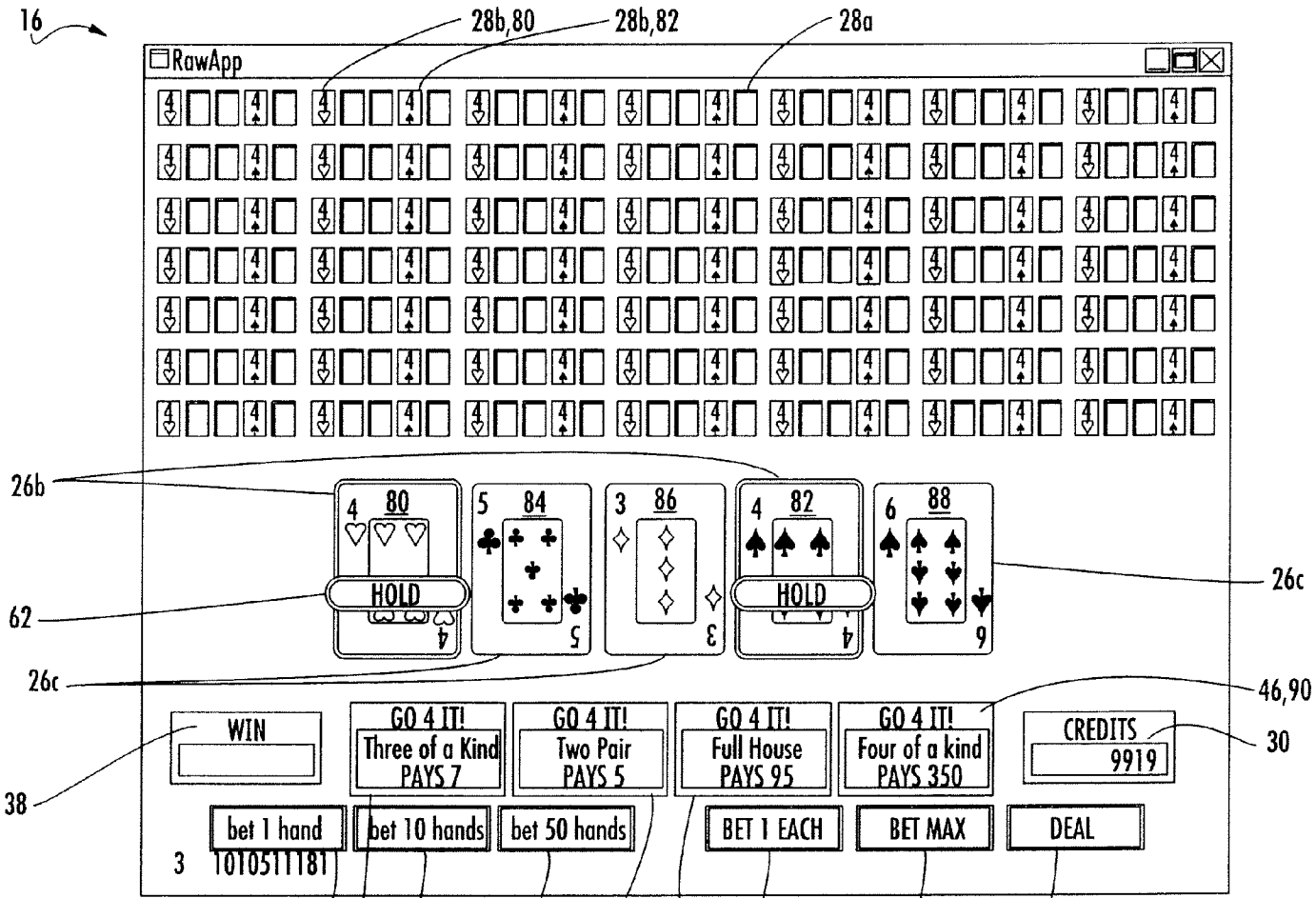
FIG. 4 is an illustration of another screen display of the first example after the player has selected which interactive cards to hold.

As shown in FIG. 4, the player elected to hold the two 4 cards 80, 82 (thereby reducing these cards to held cards 26*b*), and player accepted the "GO4IT" proposition bet associated with the four-of-a-kind combination (designated as reference number 90). In other words, the player elected to wager an additional 50 credits that the final hand would include a four-of-a-kind card combination. To elect this wager, the player touched the "GO4IT" interactive button 90 associated with the four-of-a-kind "GO4IT" proposition bet.

FIG. 5 is an illustration of a screen display in this example after the draw. The 5, 3 and 6 cards 84, 86, 88, respectively, previously designated as discarded cards 26*c* were replaced by three replacement cards 26*d*, namely a pair of 9's (designated as reference numbers 92 and 94) and a 5-of-spades (designated as reference number 96). Of the 50 hands, none attained a four-of-a-kind composition; therefore the player lost the "GO4IT" bet. However in regard to the initial pay table wager, among the fifty hands played, eight hands contained two pair, each hand having a payout value of 2 credits, thus providing a total payout value for these hands of 16 credits. Also, among the fifty hands played, six hands contained a three-of-a-kind, each having a payout value of 3 credits, thus provided a total payout value for these hands of 18 credits. Thus, the total payout value for this round was 34 credits.

EXAMPLE 2

Figure 6:
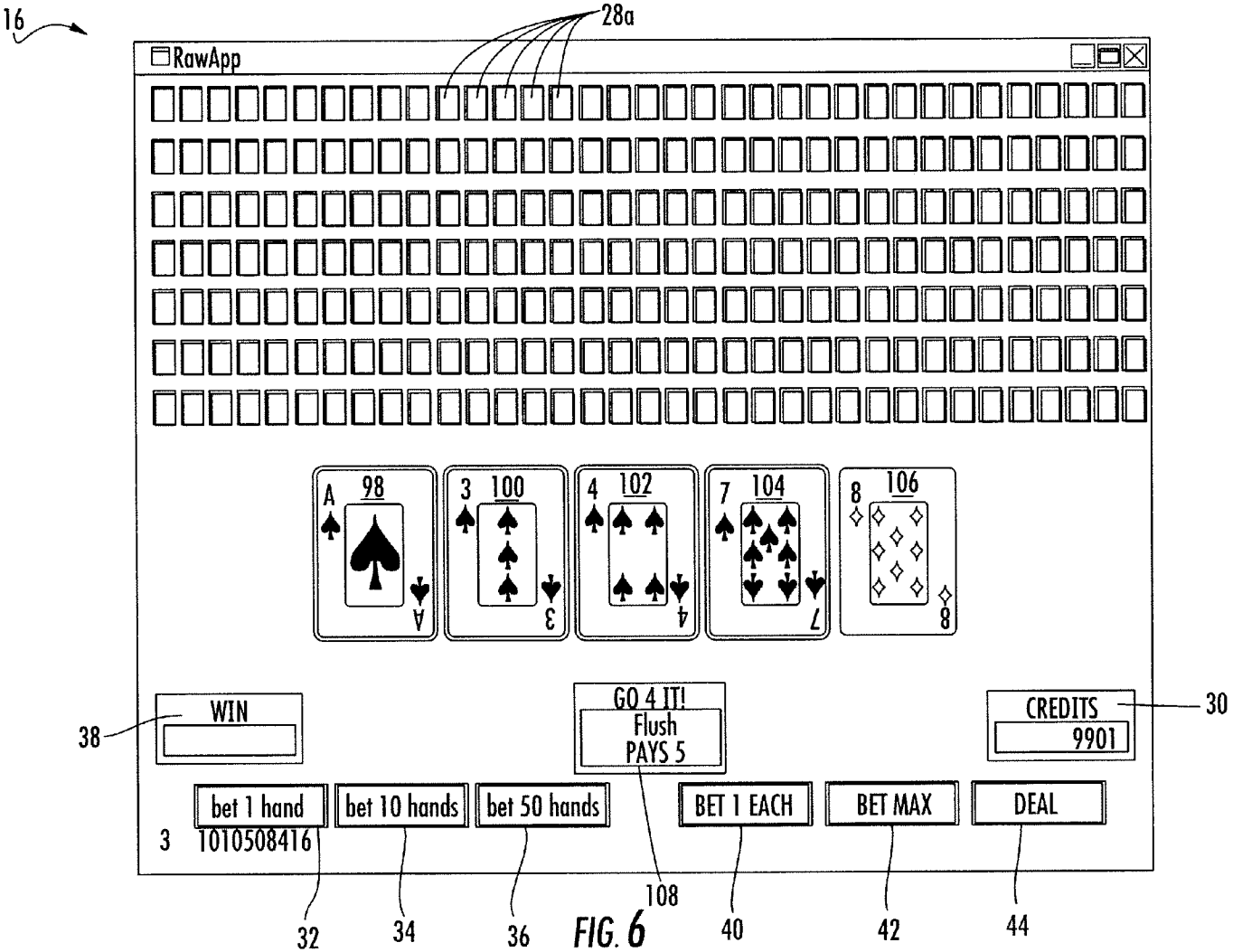
FIG. 6 is an illustration of a screen display of a second example of a round of play after an initial hand of interactive cards has been dealt.

FIG. 6 illustrates an example wherein the player elected to play fifty hands simultaneously, and wagered 1 credit per hand betting that each final hand will have one of a preselected card combination (initial pay table bet). Upon touching the "DEAL" interactive button 44, a hand of interactive dealt cards 26*a* was displayed. In this example, a four-card flush (an Ace-of-spades designated as reference number 98, a 3-of-spades designated as reference number 100, a 4-of-spades designated as reference number 102, and a 7-of-spades designated as reference number 104) was dealt, and an 8-of-diamonds (designated as reference number 106) was also dealt. One "GO4IT" interactive button 46 was displayed (designated as reference number 108) indicating possible final hand combinations in this round, and the payout value associated with the combination was displayed.

Figure 7:
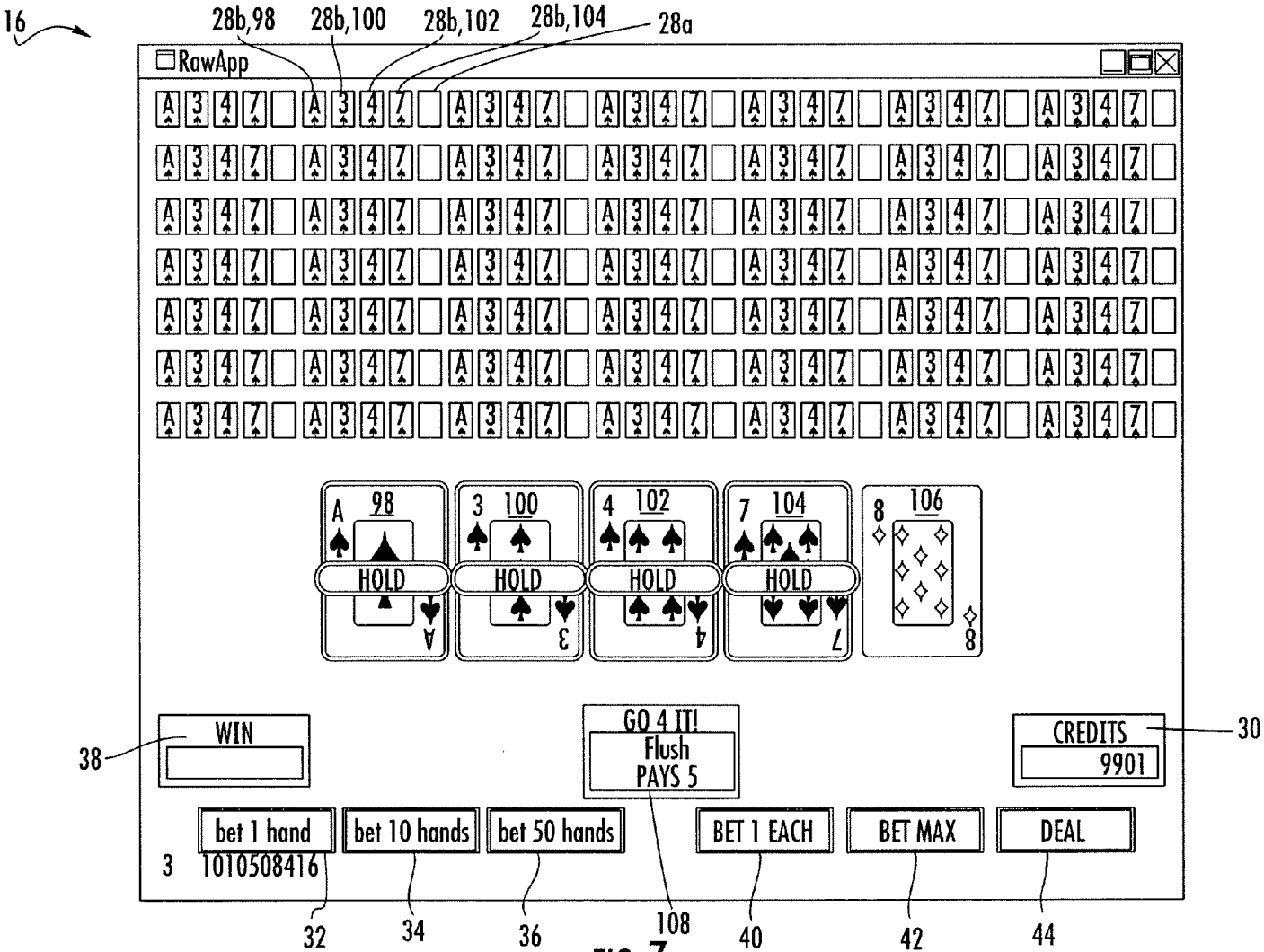
FIG. 7 is an illustration of another screen display of the second example after the player has selected which interactive cards to hold.

As shown in FIG. 7, the player elected to hold the four flush cards 98, 100, 102 and 104, respectively, (thereby reducing these cards to held cards 26*b*), and the player elected to wager an additional 50 credits that the final hand would include a five card flush. To elect this wager, the player touched the "GO4IT" interactive button 108 associated with the flush "GO4IT" proposition bet, which pays 5 for 1.

Figure 8:
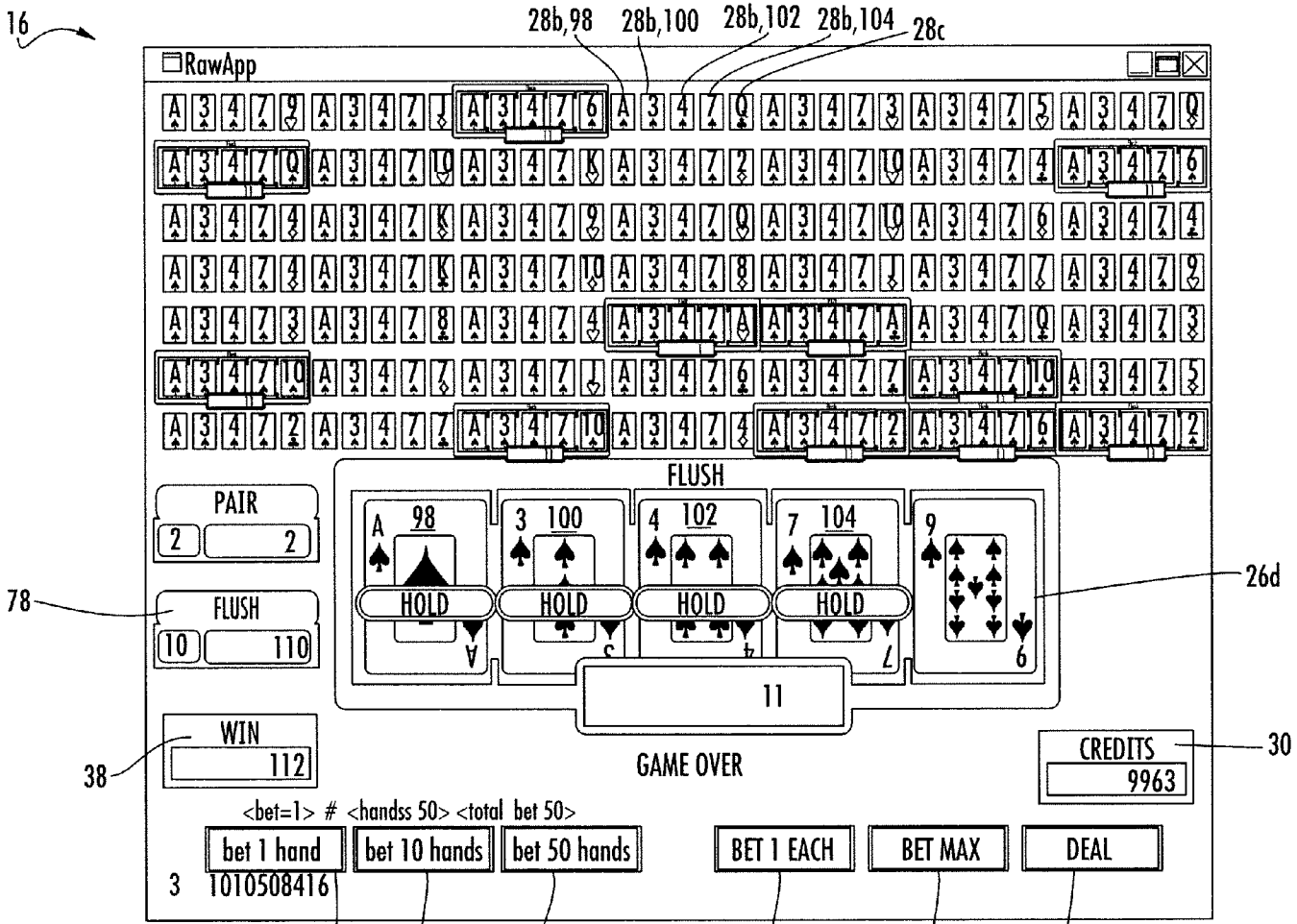
FIG. 8 is an illustration of another screen display of the second example after the draw.

FIG. 8 is an illustration of a screen display in this example after the draw. Because ten of the final hands contained a flush, the player won the "GO4IT" bet with respect to those ten hands, and the player was awarded an additional 5 credits for each hand. In regard to the player's initial pay table wager, among the 50 hands played, 2 hands contained a pair, each having a payout value of 1 credit, thus providing a total payout value for these hands of 2 credits. Also, among the fifty hands played, ten hands contained a flush, each having a payout value of 6 credits in this example (plus 5 additional credits for the "GO4IT" bet), thus providing a total flush payout value for these hands of 110 credits. Thus, the total payout value for this round was 112 credits.

EXAMPLE 3

Figure 9:
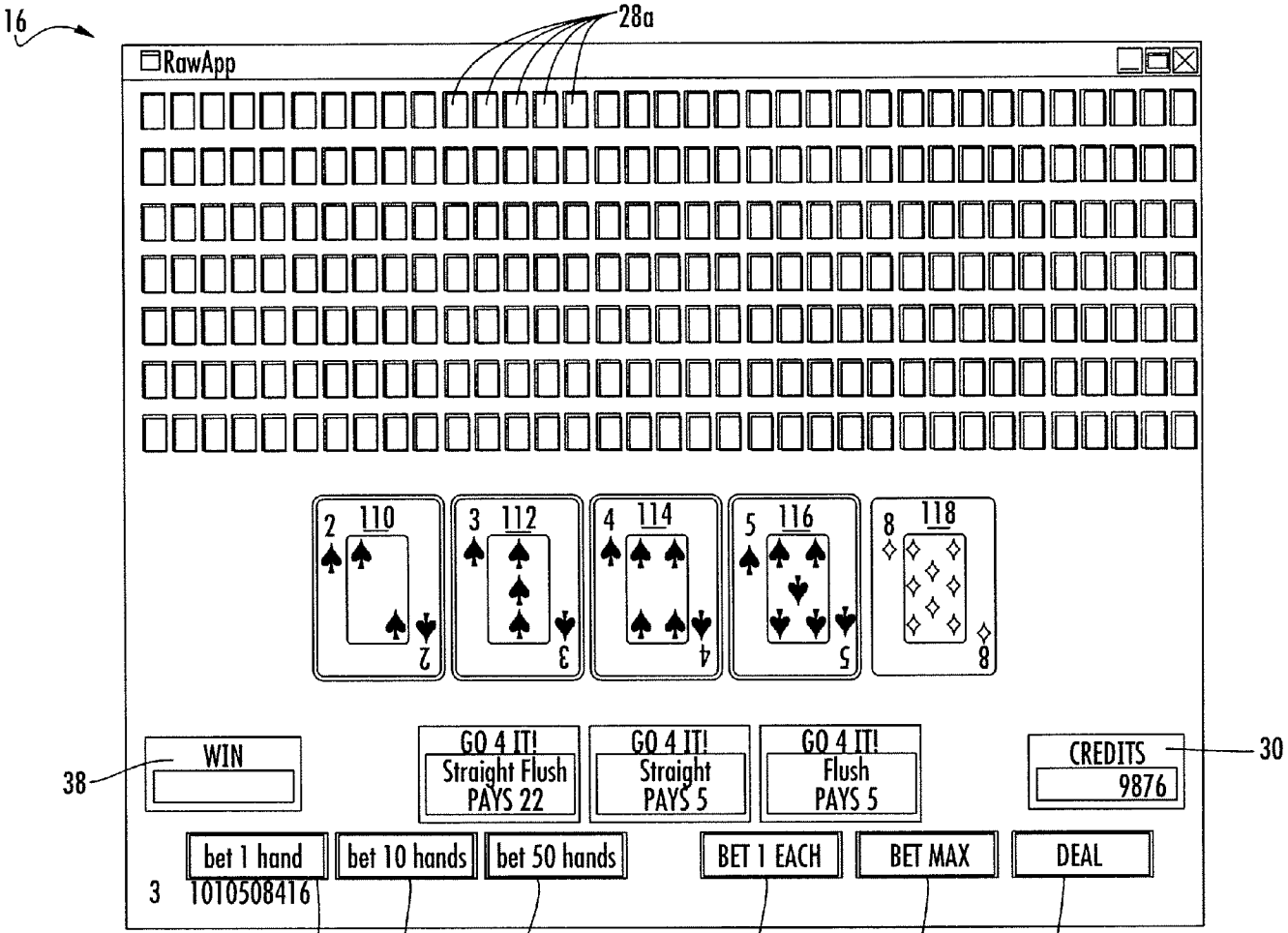
FIG. 9 is an illustration of a screen display of a third example of a round of play after an initial hand of interactive cards has been dealt.

FIG. 9 illustrates an example wherein the player elected to play fifty hands simultaneously, and wagered 1 credit per hand betting that each final hand will have one of a preselected card combination determined by a pay table. Upon touching the "DEAL" interactive button 44, a hand of interactive dealt cards 26*a* was displayed. In this example, a four-card straight flush (a 2-of-spades designated as reference number 110, a 3-of-spades designated as reference number 112, a 4-of-spades designated as reference number 114, and a 5-of-spades designated as reference number 116) was dealt, and an 8-of-diamonds designated as reference number 118 was also dealt. Three "GO4IT" interactive buttons 46 were displayed indicating three final hand combinations possible in this round, and the payout value associated with each combination was displayed.

Figure 10:
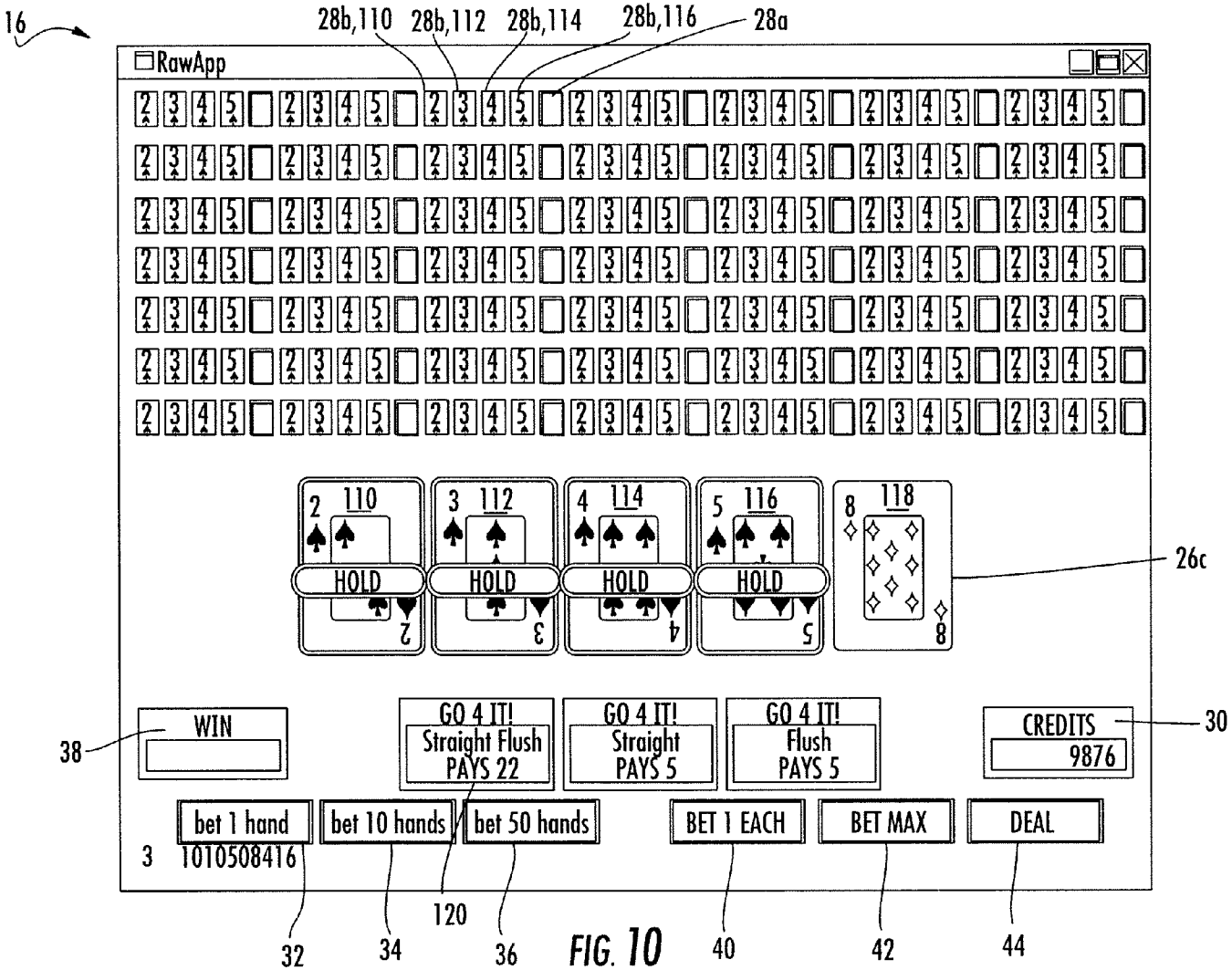
FIG. 10 is an illustration of another screen display of the third example after the player has selected which interactive cards to hold.

As shown in FIG. 10, the player elected to hold the four cards associated with the four card straight flush 110, 112, 114 and 116, respectively, (thereby reducing these cards to held cards 26*b*), and the player elected to wager an additional 50 credits that the final hand would include a straight flush. To elect this wager, the player touched the "GO4IT" interactive button 120 associated with the straight flush "GO4IT" proposition bet, which pays 22 for 1.

Figure 11:
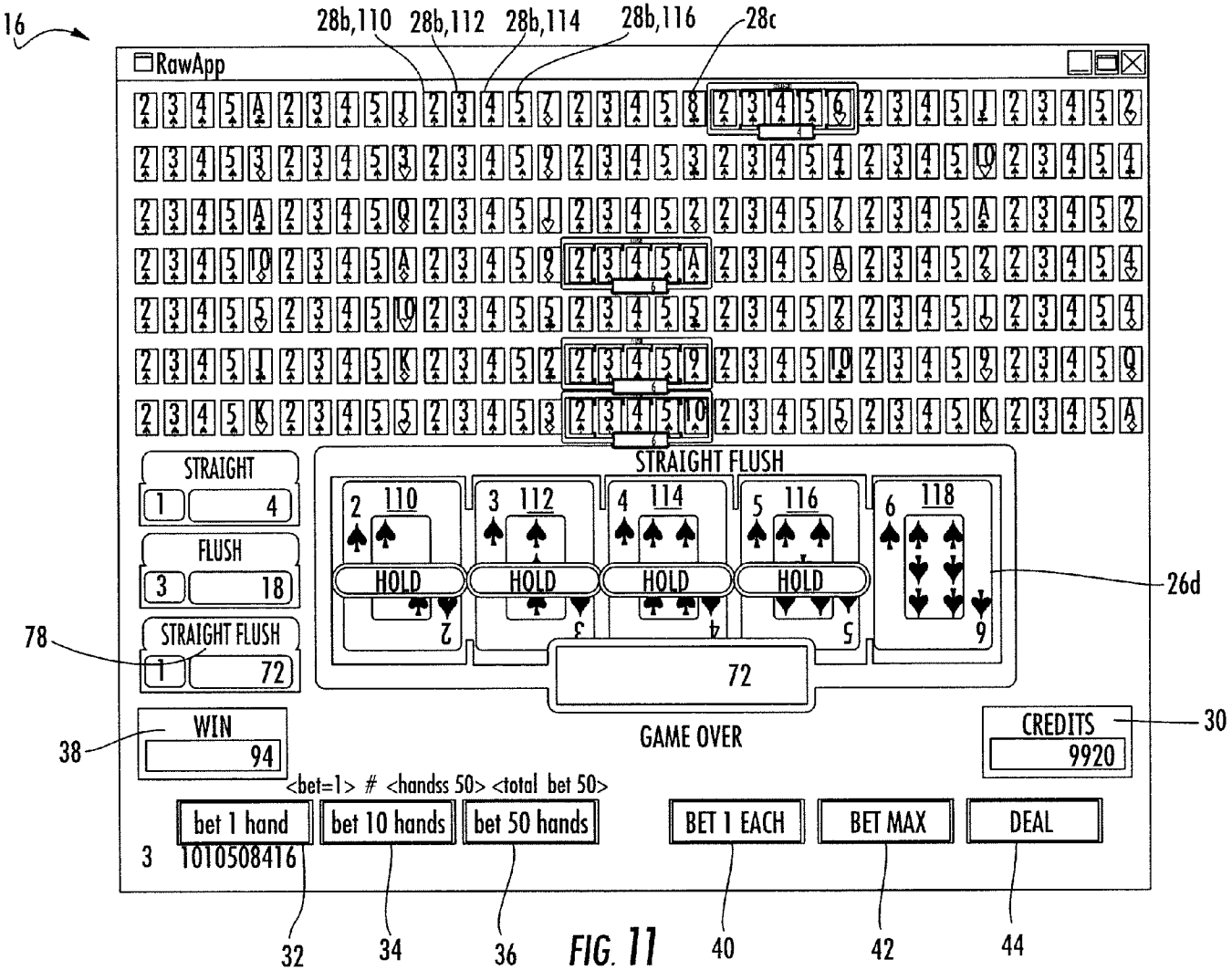
FIG. 11 is an illustration of another screen display of the third example after the draw.

FIG. 11 is an illustration of a screen display in this example after the draw. The 8 of diamonds card previously designated as an interactive discard card 26*c* was replaced by a 6 of spades generally designated as reference number 122. Thus, because one of the final hands contained a straight flush (namely the hand of interactive cards 26 designated as reference numbers 110, 112, 114, 116 and 122), the player won the "GO4IT" bet, and the player was awarded 22 credits in addition to the 50 credits awarded for a straight flush on the initial paytable bet, thus providing for a total payout of 72 credits for this hand. In addition, among the fifty hands played, one hand contained a straight, which had a payout value of 4 credits, thus providing a total payout value for this hand of 4 credits. Also, among the fifty hands played, three hands contained a flush, each having a payout value of 6 credits, thus providing a total payout value for these hands of 18 credits. Thus, the total payout value for this round was 94.

EXAMPLE 4

Figure 12:
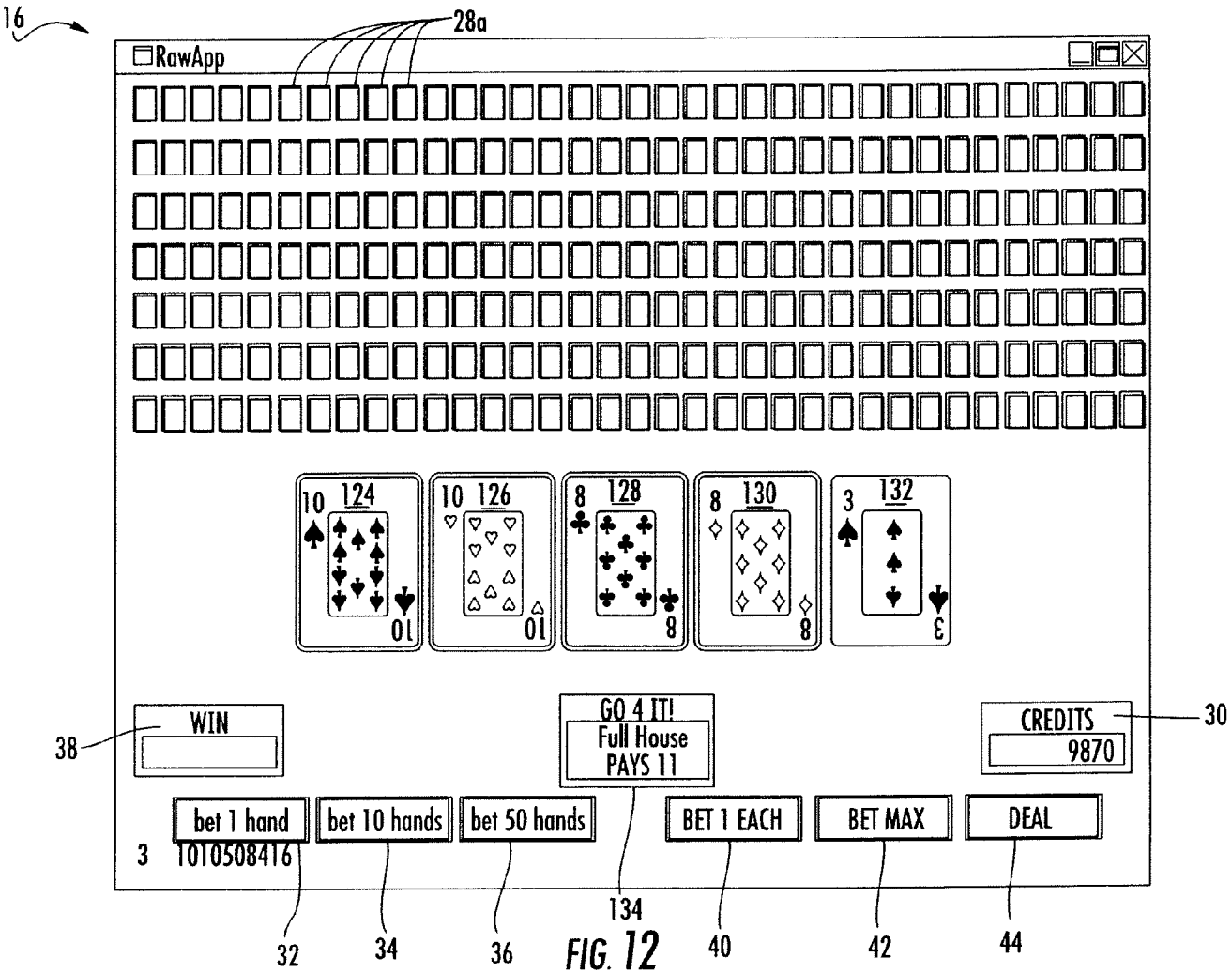
FIG. 12 is an illustration of a screen display of a fourth example of a round of play after an initial hand of interactive cards has been dealt.

FIG. 12 illustrates an example wherein the player elected to play 50 hands simultaneously, and wagered 1 credit per hand on the paytable bet. Upon touching the "DEAL" interactive button 44, a hand of interactive dealt cards 26*a* was displayed. In this example, a pair of 10's (designated as reference numbers 124 and 126), a pair of 8's (designated as reference numbers 128 and 130) and a 3-of-spades (designated as reference number 132) were dealt. One "GO4IT" interactive button 46 was displayed (designated as reference number 134) indicating the only final hand combination possible in this round, and the payout value associated with the combination was displayed.

Figure 13:
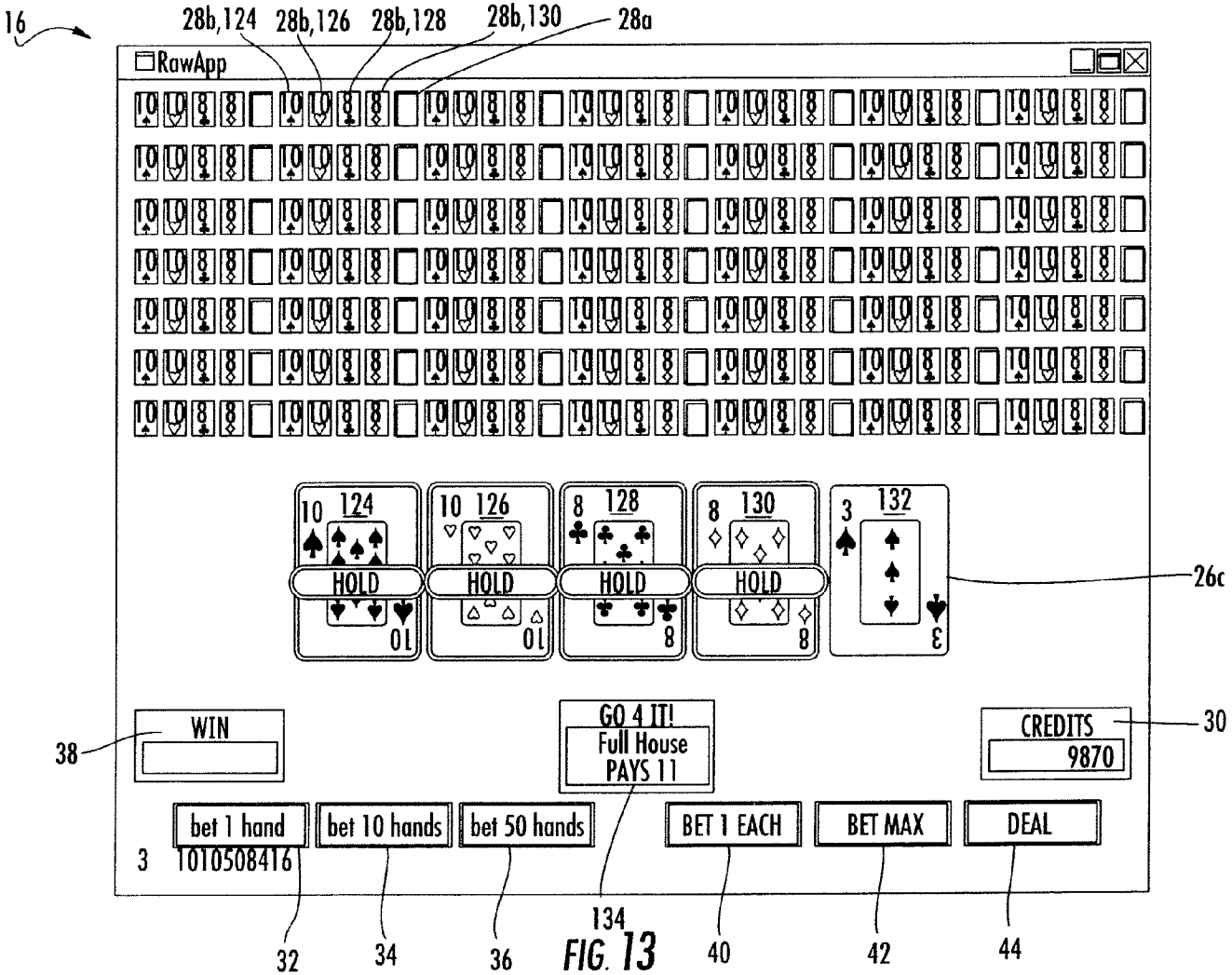
FIG. 13 is an illustration of another screen display of the fourth example after the player has selected which interactive cards to hold.

As shown in FIG. 13, the player elected to hold the two pairs 124, 126, 128 and 130, respectively, (thereby reducing these cards to held cards 26*b*), and the player elected to wager an additional 50 credits that the final hand would include a full house. To elect this wager, the player touched the "GO4IT" interactive button 134 associated with the full house "GO4IT" proposition bet (which pays 11 for 1).

Figure 14:
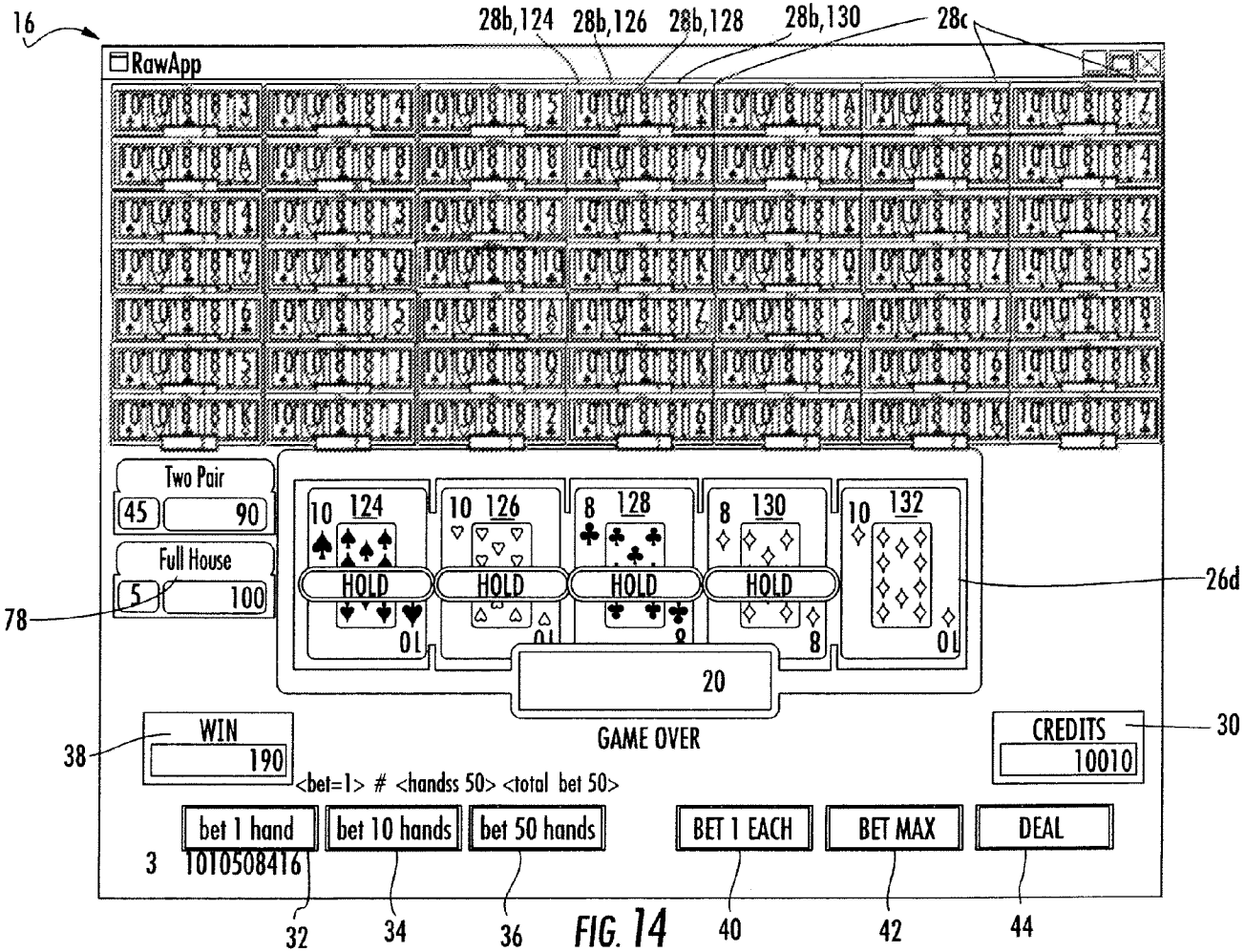
FIG. 14 is an illustration of another screen display of the fourth example after the draw.

FIG. 14 is an illustration of a screen display in this example after the draw. Because five of the final hands contained a full house, the player won the "GO4IT" bet, and the player was awarded 11 credits per hand that achieved a full house combination. A total of five final hands contained a full house, each hand having a total payout value of 20 credits (11 credits for the "GO4IT" bet and 9 credits for the initial paytable wager), thus providing a total payout value for these hands of 100 credits. In addition, the player was given credit for the two pair in the remaining 45 final hands. Thus, the player was awarded 90 credits for these 45 hands, because the initial pay table bet for these hands pays out 2 credits per hand for a 2 pair. Therefore, the total payout for this round of play is 190 credits.

The foregoing description of one or more embodiments of the invention have been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims as set forth below.

What is claimed is:

1. A method of playing a draw poker game including initially dealt cards, an opportunity for a player to hold at least one of said initially dealt cards and a final hand composition, said method comprising:

placing a first wager that a final hand composition will match one of a plurality of preselected combination of cards that are ranked in a particular order;

dealing a hand of initially dealt cards;

determining whether said initially dealt cards match one of said plurality of preselected combination of cards and determining a ranking of said initially dealt cards;

selecting none, one, or more held cards from said hand of dealt cards;

offering at least one proposition bet that the final hand composition will match a particular one of said plurality of preselected combination of cards after said initially dealt cards are dealt and prior to replacing each card not held, unless all initially dealt cards are held, wherein said particular one of said plurality of preselected combination of cards is ranked higher than the ranking of said initially dealt cards;

accepting said at least one proposition bet as a second wager if said proposition bet is offered;

dealing one additional card to replace each card not held to provide a final hand composition;

determining if said final hand composition matches said at least one proposition bet, if said at least one proposition bet is offered and accepted; and determining if said final hand matches one of said plurality of preselected combination of cards as to the first wager.

2. The method of claim 1 wherein the poker game is 5-card draw poker.

3. The method of claim 2 wherein the held cards are automatically held upon acceptance of the second wager.

4. The method of claim 1 wherein said plurality of preselected combination of cards comprises: Royal Flush, Straight Flush, Straight, Flush, Full House, Three of a Kind, Two Pair and One Pair.

5. The method of claim 1 wherein said machine automatically determines the player cards to hold when the player places the wager.

6. A method of playing a draw poker game including initially dealt cards, an opportunity for a player to hold at least one of said initially dealt cards and a final hand composition, said method comprising:

placing a first wager that a final hand composition will match one of a plurality of preselected combination of cards that are ranked in a particular order;

dealing a hand of initially dealt cards;

determining whether said initially dealt cards match one of said plurality of preselected combination of cards and determining a ranking of said initially dealt cards;

offering at least one proposition bet, after said initially dealt cards are dealt, that said final hand composition will match a particular one of said plurality of preselected combination of cards that is ranked higher than the ranking of said initially dealt cards, unless it is not possible to improve the poker hand ranking of the initially dealt cards;

selecting none, one, or more held cards from said hand of dealt cards;

accepting said at least one proposition bet as a second wager if said proposition bet is offered prior to replacing each card not held;

dealing one additional card to replace each card not held, to provide a final hand composition;

determining if said final hand composition matches said at least one proposition bet, if said at least one proposition bet is offered and accepted; and determining if said final composition hand matches one of said plurality of preselected combination of cards as to the first wager.

7. The method of claim 6 where the poker game is 5-card draw poker.

8. The method of claim 7 wherein the held cards are automatically held upon acceptance of the second wager.

9. A method for playing a poker game including an initially dealt hand of cards, a final hand composition and rankings of possible poker hands, said method comprising:

placing a first wager that a final hand composition will match one of a plurality of preselected combination of cards that are ranked in a particular order;

dealing one or more initially dealt cards;

analyzing said dealt cards and undealt cards to determine possible final hand compositions and to determine whether said initially dealt cards match one of said plurality of preselected combination of cards and a ranking of said initially dealt cards;

providing at least one proposition bet, after said initially dealt cards are dealt, that said final hand composition will match a particular one of said plurality of preselected combination of cards that is ranked higher than the ranking of said initially dealt cards, unless it is not possible to improve the ranking of the initially dealt cards;

accepting said at least one proposition bet and making a second wager;

dealing the necessary cards to complete the hand providing said final hand composition;

determining if said final hand composition matches said at least one proposition bet; and determining if said final hand matches one of a plurality of preselected combination of cards with respect to said first wager.

10. A poker game played by a player including an initial hand of cards and a final hand of cards that is created by replacing selected cards from the initial hand of cards, wherein wagers may be placed that said final hand of cards will match one of a plurality of preselected combination of cards that are ranked in a particular order, said poker game comprising:

a computing device for implementing said game, said computing device having a screen display;

a microprocessor in communication with said screen display;

a selection device in communication with said microprocessor for providing means by which the player interacts with said computing device;

a power supply in electrical communication with said screen display, said microprocessor and said selection device for providing power thereto;

a hand of cards displayed on said screen display;

card determining means in communication with said computing device for randomly determining in succession the composition of said initial hand of cards and for randomly determining the composition of said final hand of cards;

means for determining whether said initial hand of cards matches one of said plurality of preselected combination of cards and a ranking thereof, and card combination determining means for analyzing said hand of cards to determine possible final hands so as to provide the player with at least one proposition bet that said final hand of cards will match one of said plurality of preselected combination of cards that is ranked higher than the ranking of said initial hand of cards, wherein said proposition bet is selected after said initial hand of cards is displayed and prior to replacing the selected cards from the initial hand of cards.

11. A poker game played by a player including an initial hand of cards and a final hand of cards that is created by replacing selected cards from the initial hand of cards, wherein wagers may be placed that said final hand of cards will match one of a plurality of preselected combination of cards that are ranked in a particular order, said poker game said game comprising:

a computing device for implementing said game, said computing device having a screen display;

a microprocessor in communication with said screen display;

a selection device in communication with said microprocessor for providing means by which the player interacts with said computing device;

a power supply in electrical communication with said screen display, said microprocessor and said selection device for providing power thereof;

an initial hand of cards displayed on said screen display;

card determining means in communication with said computing device for randomly determining in succession the composition of said initial hand of cards and for randomly determining the composition of said final hand of cards;

means for determining whether said initial hand of cards matches one of said plurality of preselected combination of cards and a ranking thereof, and card combination determining means for analyzing said initial hand of cards to determine possible final hands to provide the player with a plurality of proposition bets that said final hand of cards will match one of said plurality of preselected combination of cards that is ranked higher than said ranking of said initial hand of cards, wherein one or more of said plurality of proposition bets is selected after said initial hand of cards is displayed and prior to replacing the selected cards from the initial hand of cards, and, said card determining means determining the composition of said final hand of cards and dealing the cards needed to complete the hand, so as to provide a payout to the player based on the composition of said final hand of cards.

* * * * *

UNITED STATES PATENT AND TRADEMARK OFFICE

CERTIFICATE OF CORRECTION

PATENT NO. : 7,201,654 B1
APPLICATION NO. : 10/077740
DATED : April 10, 2007
INVENTOR(S) : Jarvis et al.

It is certified that error appears in the above-identified patent and that said Letters Patent is hereby corrected as shown below:

Column 18

Line 43, replace “thereof” with --thereto--

Signed and Sealed this

Thirteenth Day of May, 2008

JON W. DUDAS
*Director of the United States Patent and Trademark Office*